US006174852B1

(12) United States Patent
Hayashi et al.

(10) Patent No.: US 6,174,852 B1
(45) Date of Patent: Jan. 16, 2001

(54) HIGH-DENSITY POWDERED DETERGENT COMPOSITION

(75) Inventors: Hiromitsu Hayashi; Toshiharu Noguchi; Masaki Tsumadori; Masaaki Yamamura; Noboru Moriyama, all of Wakayama (JP)

(73) Assignee: Kao Corporation, Tokyo (JP)

( * ) Notice: Under 35 U.S.C. 154(b), the term of this patent shall be extended for 0 days.

(21) Appl. No.: 09/117,026

(22) PCT Filed: Jan. 21, 1997

(86) PCT No.: PCT/JP97/00109

§ 371 Date: Jul. 22, 1998

§ 102(e) Date: Jul. 22, 1998

(87) PCT Pub. No.: WO97/27277

PCT Pub. Date: Jul. 31, 1997

(30) Foreign Application Priority Data

Jan. 22, 1996 (JP) ..... 8-08558
Feb. 21, 1996 (JP) ..... 8-033786

(51) Int. Cl.[7] ..... C11D 3/26; C11D 1/83; C11D 3/08

(52) U.S. Cl. ..... 510/480; 510/351; 510/361; 510/444; 510/507; 510/533

(58) Field of Search ..... 510/507, 533, 510/444, 480, 361, 351

(56) References Cited

U.S. PATENT DOCUMENTS

| | | | | |
|---|---|---|---|---|
| 3,915,878 | * | 10/1975 | Yurko et al. | 510/349 |
| 4,085,243 | * | 4/1978 | Giordano et al. | 427/387 |
| 4,997,587 | * | 3/1991 | Baur et al. | 510/316 |
| 5,719,111 | * | 2/1998 | Van Den Brom et al. | 510/224 |
| 5,750,483 | * | 5/1998 | Welch et al. | 510/230 |
| 5,783,524 | * | 6/1998 | Greindl et al. | 507/90 |
| 5,786,131 | * | 6/1998 | Schneider et al. | 430/325 |
| 5,837,666 | * | 12/1998 | Murata et al. | 510/299 |
| 5,849,950 | * | 12/1998 | Greindl et al. | 562/571 |
| 5,858,952 | * | 1/1999 | Izawa et al. | 510/392 |

FOREIGN PATENT DOCUMENTS

| | | | | |
|---|---|---|---|---|
| 19543162 A1 | | 5/1997 | (DE) | C11D/3/08 |
| 0164514 | | 12/1985 | (EP) . | |
| 0560395 | | 9/1993 | (EP) . | |
| 0 845 456 A2 | * | 6/1998 | (EP) | C07C/227/42 |
| 58-51994 | | 11/1983 | (JP) . | |
| 60-227895 | | 11/1985 | (JP) . | |
| 62-45696 | | 2/1987 | (JP) . | |
| 63-161097 | | 7/1988 | (JP) . | |
| 2-163200 | | 6/1990 | (JP) . | |
| 2-178398 | | 7/1990 | (JP) . | |
| 5-170714 | | 7/1993 | (JP) . | |
| 5-184946 | | 7/1993 | (JP) . | |
| 6-10000 | | 1/1994 | (JP) . | |
| 6-9999 | | 1/1994 | (JP) . | |
| 6-116588 | | 4/1994 | (JP) . | |
| 6-248300 | | 9/1994 | (JP) . | |
| 70-53992 | | 2/1995 | (JP) . | |
| 8-311493 | | 11/1996 | (JP) . | |
| 8-511255 | | 11/1996 | (JP) . | |
| 94/29421 | * | 12/1994 | (WO) | C11D/3/33 |
| WO 9502682 | | 1/1995 | (WO) . | |
| 95/33815 | * | 12/1995 | (WO) | C11D/3/37 |

OTHER PUBLICATIONS

New Horizons' 95 Conference Lake George, New York, Sep. 19–22, 1995.

* cited by examiner

*Primary Examiner*—Yogendra Gupta
*Assistant Examiner*—Christine E. Ingersoll
(74) *Attorney, Agent, or Firm*—Birch, Stewart, Kolasch & Birch, LLP

(57) ABSTRACT

A high-density powdered detergent composition which has a bulk density of 0.6 to 1.2 g/ml and which comprises 0.5 to 30% by weight of (a) a glycine-N,N-diacetic acid derivative, 20 to 50% by weight of (b) an anionic surfactant, 0.5 to 5% by weight of (c) an ether-type nonionic surfactant having an HLB value of 10.5 to 15.0 and 1 to 30% by weight of (d) an aluminosilcate, each percentage being based on the total weight of the composition, and the component (c) being contained in an amount of 0.5 to 10.0 parts by weight per 100 parts by weight of the component (b). This composition contains both a glycine-N,N-diacetic acid derivative which is a builder excellent in biodegradability and sequestering power and an inorganic builder such as zeolite or crystalline silicate, and exhibits high detergency.

20 Claims, No Drawings

HIGH-DENSITY POWDERED DETERGENT COMPOSITION

BACKGROUND OF THE INVENTION

1. Field of the Invention

The present invention relates to a high-density powdered detergent composition. In particular, it relates to a high-density powdered detergent composition exhibiting high detergency and containing an organic builder excellent in biodegradability.

2. Description of Related Art

A detergent composition for clothes is basically composed of a surfactant which solubilizes soil, separates it from fibers, and dissolves or disperses it in a washing solution, an alkaline substance which accelerates the decomposition or solubilization of soil, a high-molecular compound which suspends soil in a washing solution, a sequestering agent which removes substances lowering the power of surfactants, for example, calcium or magnesium ions from a washing solution, and so on.

Among these components, "builders for detergents" generally refer to substances which do not exhibit detergency per se but can enhance the detergency of a surfactant when used together with the surfactant. Among such builders for detergents, the above-mentioned sequestering agent serves to make a surfactant exhibit its performance more effectively, thus being one of the extremely important builders for detergents.

Phosphate salts such as sodium tripolyphosphate were formerly added to detergents for clothes as the sequestering agent. However, phosphate salts are believed to be one of the factors causing the eutrophication of lakes, marshes and so on. In the detergent industry, therefore, the development of a detergent not containing any phosphate builder has been continued. As a result, a crystalline sodium aluminosilicate having a specific structure (which is called "zeolite" in the detergent industry) is currently used as the main component of the sequestering agent, because it is free from the above problem associated with phosphate builders and has recently stabilized in cost.

Further, a detergent composition for clothes has changed in the form from the late 1980s, so that a so-called compact detergent which has a high bulk density and is lowered in the volume of the composition used per washing run is now widely used. However, the particles constituting such a compact detergent are more highly compacted than those constituting the detergent of the prior art, thus being problematic in solubility. In particular, a zeolite which is one of the constituents of the compact detergent is insoluble in water per se, and therefore often causes the generation of water insolubles in conducting washing with the compact detergent. The present inventors have made attempts to solve this problem by exerting inventive skill in the formulation of the compact detergent. However, such a formulation has, in the past, been severely limited in efficacious compositions. Under these circumstances, the development of a more excellent builder for detergents is being made for the purpose of attaining progress of the industry.

In addition to zeolite, crystalline silicates are also used as builders for detergents. For example, JP-A 60-227895 discloses the use of crystalline silicates as water softeners; JP-A 6-10000, 2-178398 and 7-53992 disclose detergent compositions containing crystalline silicates; and JP-A 5-184946 and 6-116588 disclose specific crystalline silicates and detergent compositions containing them.

As described above, zeolite is a water-insoluble builder for detergents. On the other hand, water-soluble builders for detergents include organic builders such as salts of polycarboxylic acids, and specific examples of such salts include citrates, malates, salts of nitrilotriacetic acid (NTA), salts of ethylenediaminetetraacetic acid (EDTA) and polymers of carboxylated vinyl compounds. The term "polymers of carboxylated vinyl compounds" refers to, e.g., polyacrylate salts, salts of acrylic acid/maleic acid copolymers, and salts of olefin/maleic acid copolymers, whose molecular weights lie within the oligomeric region. However, these organic builders have the disadvantages of unsatisfactory sequestering power toxicity to fish and/or poor biodegradability, so that the concern is shown for the use of the organic builders.

From the standpoint of the influence on the environment, studies have recently been made on builders excellent in biodegradability and sequestering power. For example, specific organic builders prepared by the reaction of epoxysuccinic acid or maleic acid with aspartic acid and detergent compositions containing them are disclosed in JP-A 5-170714, and this patent document also describes that these builders are excellent in biodegradability and detergency-enhancing effect. Further, JP-A 6-248300 discloses a detergent composition containing an organic builder consisting of hydroxyiminodisuccinic acid salts in a specific amount. Furthermore, it has been reported by BASF that glycine-N, N-diacetic acid derivatives are excellent in biodegradability and sequestering power, and are therefore extremely suitable for builders for detergents (New Horizons' 95 Conference Lake George, N.Y., Sep. 19–22, 1995). In the detergent composition reported in this conference, a surfactant mixture comprising 9% of FAS (a salt of sulfate ester of higher aliphatic alcohol) and 10% of a nonionic surfactant is used together with a glycine-N,N-diacetic acid derivative, zeolite, soda ash, perboric acid and/or TAED (tetraacetylethylenediamine).

Meanwhile, it is believed that there is a good possibility of further enhancing the detergency of a detergent composition containing a glycine-N,N-diacetic acid derivative as the organic builder. In particular, no optimum formulation has been found as yet with respect to a high-density detergent composition which comprises a surfactant component comprising an anionic surfactant as the base and a small amount of a specific nonionic surfactant exhibiting high detergency against oleaginous dirt, and a builder component comprising both the above organic builder and an inorganic builder such as zeolite or crystalline silicate.

DISCLOSURE OF INVENTION

Summary of the Invention

Under these circumstances, the present invention provides a high-density detergent composition improved in detergency, comprising the above organic builder having excellent biodegradability and a surfactant component comprising an anionic surfactant as the base and a small amount of a specific nonionic surfactant, and further contains an inorganic builder.

The inventors of the present invention have made extensive studies for attaining the above aim. As a result of the studies, they have found that the detergency of a surfactant system comprising an anionic surfactant as the base and a small amount of a specific nonionic surfactant can be enhanced by adding both a glycine-N,N-diacetic acid derivative serving as an organic builder and an inorganic builder in specific proportions respectively to the system. The present invention has been accomplished on the basis of this finding.

Namely, the present invention provides a high-density powdered detergent composition which has a bulk density of 0.6 to 1.2 g/ml and which comprises 0.5 to 30% by weight of (a) a glycine-N,N-diacetic acid derivative represented by the following formula (I), 20 to 50% by weight of (b) an anionic surfactant, 0.5 to 5% by weight of (c) an ether-type nonionic surfactant having an HLB (Hydrophile Lypophile Balance) value of 10.5 to 15.0 and 1 to 30% by weight of (d) an aluminosilcate, each percentage being based on the total weight of the composition, and the component (c) being contained in an amount of 0.5 to 10.0 parts by weight per 100 parts by weight of the component (b):

(I)

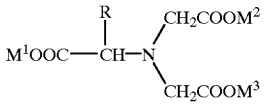

wherein R is $C_1$–$C_{18}$ alkyl or $C_2$–$C_{18}$ alkenyl; and $M^1$, $M^2$ and $M^3$ are each H, Na, K or $NH_4$.

In other words, the present invention relates to a high-density powdered detergent composition which comprises 0.5 to 30% by weight of (a) a glycine-N,N-diacetic acid derivative represented by the following formula (Ia):

(Ia)

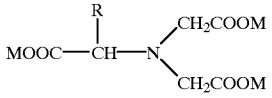

(wherein R is $C_1$–$C_{18}$ alkyl or alkenyl; and M is H, Na, K or $NH_4$), 20 to 50% by weight of (b) an anionic surfactant, 0.5 to 5% by weight of (c) an ether-type nonionic surfactant having an HLB (Hydrophile Lypophile Balance) value of 10.5 to 15.0, and 1 to 30% by weight of (d) an aluminosilicate, with the content of the component (c) being 0.5 to 10.0 parts by weight per 100 parts by weight of the component (b), and which has a bulk density of 0.6 to 1.2 g/ml.

The high-density powdered detergent composition of the present invention will now be described in detail.

DETAILED DESCRIPTION OF THE INVENTION

<(a) Organic builder>

The organic builder to be used in the present invention is a glycine-N,N-diacetic acid derivative represented by the formula (I).

In the formula (I), $M^1$, $M^2$ and $M^3$ (i.e., counter ions) are each generally hydrogen ion, sodium ion or potassium ion.

In the present invention, it is necessary from the standpoint of the detergency of the detergent composition that the organic builder (a) is contained in the composition in an amount of 0.5 to 30% by weight, preferably 2 to 15% by weight.

Specific examples of the compound (a) to be used in the present invention as the organic builder are disclosed in DE-A1 4319935, WO 94/29421 and so on. That is, the compounds (a) are known as builders to the public. However, what has been known about the compounds is only that the compounds function as ordinary builders for detergents. In the present invention, meanwhile, an organic builder is added to a system comprising a surfactant mixture which comprises an anionic surfactant as the base and a small amount of a specific nonionic surfactant and exhibits both ionic properties and the properties of a nonionic surfactant including excellent detergency against oleaginous dirt, and an inorganic builder. With respect to such a case, there is no information on which formulation can give the optimum detergency.

<(b) Anionic surfactant>

Examples of the anionic surfactant include $C_{10}$–$C_{18}$ higher fatty acid salts, salts of sulfates of $C_{10}$–$C_{18}$ linear and branched primary and secondary alcohols, salts of sulfates of $C_8$–$C_{20}$ alcohol ethoxylates, alkyl($C_8$–$C_{18}$)benzenesulfonic acid salts, paraffin-sulfonic acid salts, α-olefinsulfonic acid salts, α-sulfofatty acid salts and salts of alkyl esters of α-sulfofatty acids.

These anionic surfactants may be used each alone or as a mixture of two or more of them.

It is necessary from the standpoint of the detergency that the component (b) is contained in the composition in an amount of 20 to 50% by weight, preferably 20 to 40%.

<(c) Nonionic surfactant>

The component (c) according to the present invention is an ether-type nonionic surfactant, specifically a polyoxyethylene alkyl ether which is prepared by the addition reaction of a linear or branched primary or secondary alcohol having 10 to 18 carbon atoms with on the average 4 to 13, preferably 5 to 10 ethylene oxide molecules. Such a nonionic surfactant has an HLB value (as calculated by Griffin's method) of 10.5 to 15.0, preferably 11.0 to 14.0.

The component (c) is contained in the composition in an amount of 0.5 to 5% by weight, preferably 1 to 4.5% by weight. When the amount of the component (c) exceeds 5% by weight, the resulting surfactant composition will be poor in detergency against inorganic dirt (power of washing inorganic dirt off) owing to its unsatisfactory ionic properties, while when it is less than 0.5%, no contribution of the use of a noionic surfactant toward the detergency will be observed. Further, the component (c) must be used in an amount of 0.5 to 10.0 parts by weight per 100 parts by weight of the component (b).

<(d) Aluminosilicate>

The aluminosilicate to be used in the present invention as the component (d) may be any of amorphous and crystalline ones.

It is preferable that the amorphous aluminosilicate be one containing silicon in an amount of 30% by weight or above, still preferably 40% by weight or above in terms of $SiO_2$. Further, the use of such an amorphous aluminosilicate as to give a 5% dispersion (a dispersion of 5 g of a sample in 100 ml of water free from carbonic acid) having a pH of 9 or above brings about a detergent composition which exhibits excellent solubility even after the storage under high-humidity conditions. In other words, such an amorphous aluminosilicate is effective in protecting the detergent composition from the deterioration of solubility caused by storage under high-humidity conditions. The term "pH" used above with respect to a 5% amorphous aluminosilicate dispersion refers to a value as determined according to JIS K6220.

Examples of the amorphous aluminosilicate to be used in the present invention include those represented by the following formula (i):

$$a(M_2O).Al_2O_3.b(SiO_2).c(H_2O) \quad \text{(i)}$$

wherein M is alkali metal; and a, b and c represents the molar proportions of the constituent components respectively. In general, a is a number of 0.7 to 2.0, b is a number of 0.8 or above but below 4, and c is an arbitrary positive number.

These amorphous aluminosilicates exhibit high oil absorption and high cation exchange capacity.

Among the above amorphous aluminosilicates, those represented by the following formula (ii) are particularly preferable:

$$Na_2O.Al_2O_3.b(SiO_2).c(H_2O) \quad \text{(ii)}$$

wherein b is a number of 1.8 to 3.2; and c is a number of 1 to 6.

Such amorphous aluminosilicates can be prepared by referring to the process disclosed in JP-A 6-179899 and EP-A 593014 corresponding thereto.

On the other hand, crystalline aluminosilicate is generally called "zeolite", and is represented by the following formula (iii):

$$a'(M_2O).Al_2O_3.b'(SiO_2).w(H_2O) \quad \text{(iii)}$$

wherein M is alkali metal; and a', b' and w represent the molar proportions of the constituent components respectively, with a', b' and w being generally a number of 0.7 to 1.5, a number of 0.8 or above but below 6, and an arbitrary positive number, respectively.

Among the above crystalline aluminosilicates, those represented by the following formula (iv) are particularly preferable:

$$Na_2O.Al_2O_3.n(SiO_2).w(H_2O) \quad \text{(iv)}$$

wherein n is a number of 1.8 to 3.0; and w Is a number of 1 to 6.

The crystalline aluminosilicate (zeolite) to be used in the present invention is desirably a synthetic zeolite having a mean primary particle diameter of 0.1 to 10 $\mu$m, for example, zeolite A, X or P. The zeolite may be added in the form of a powder and/or a dry agglomerate prepared by drying a zeolite slurry.

In the present invention, it is necessary from the standpoint of the detergency of the resulting detergent composition that the aluminosilicate (d) is contained in the composition in an amount of 1 to 30% by weight, preferably 5 to 25% by weight.

Although the high-density powdered detergent composition of the present invention comprises the above components (a) to (d) as the essential components, it may further contain the following components.

<Crystalline silicate>

It is desirable from the standpoint of detergency that the high-density powdered detergent composition of the present invention contains a crystalline silicate. The crystalline silicate to be used in the present invention is preferably one essentially consisting of silicon dioxide ($Si_2O$) and an alkali metal oxide (i.e., an alkali metal silicate), still preferably an alkali metal silicate having an $SiO_2$ to $M_2O$ ratio (wherein M is alkali metal) of 0.5 to 2.6. Although there have been known crystalline silicates having $SiO_2$ to $M_20$ ratios (wherein M is Na) of 1.9 to 4.0, crystalline silicates having silicone dioxide to alkali metal oxide ratios exceeding 2.6 are often unusable as the constituent of the high-density powdered detergent composition of the present invention.

Examples of the crystalline silicate to be favorably used in the present invention include those having the following compositions (II) and (III):

$$x(M_2O).y(SiO_2).z(Me_mO_n).w(H_2O) \quad \text{(II)}$$

wherein M is a Group Ia element of the periodic table; Me is at least one element selected from among Group IIa, IIb, IIIa, IVa and VIII elements of the periodic table; y/x is a number of 0.5 to 2.6, preferably 1.5 to 2.2; z/x is a number of 0.01 to 1.0, preferably 0.02 to 0.9, still preferably 0.02 to 0.5; w is a number of 0 to 20; and n/m is a number of 0.5 to 2.0, and $$M_2O.x'(SiO_2).y'(H_2O) \quad \text{(III)}$$

wherein M is alkali metal; x' is a number of 1.5 to 2.6; and y' is 0 to 20.

Specific examples of the crystalline silicate represented by the above formula (II) are disclosed in JP-A 5-279013 and 7-89712 and U.S. Pat. No. 5,427,711 corresponding to them. The crystalline silicates disclosed therein can be used in the present invention.

The crystalline silicate represented by the formula (II) exhibits a pH of 11 or above in the state of a 0.1% by weight aqueous dispersion. That is, it is excellent in alkalinizing power (power of making an aqueous system basic by being dispersed or dissolved in the system). Further, the crystalline silicate exhibits a particularly high buffer capacity in the alkaline (basic) region and its buffer capacity is higher than that of sodium carbonate or potassium carbonate.

The crystalline silicate represented by the formula (II) has an ion exchange capacity of at least 100 $CaCO_3$ mg/g, preferably 200 to 600 $CaCO_3$ mg/g, and therefore serves as one of the substances capable of capturing ions in the present invention.

As described above, the crystalline silicate represented by the formula (II) exhibits both a high alkalinizing power and a high buffer capacity in the alkaline (basic) range, and further has a high ion exchange capacity.

It is preferable that the crystalline silicate represented by the formula (II) have a mean particle diameter of 0.1 to 100 $\mu$m, still preferably 1 to 60 $\mu$m. When the mean particle diameter exceeds 100 $\mu$m, the development of the ion exchange power of the silicate will be so slow as to bring about a lowering in the detergency, while when it is less than 0.1 $\mu$m, the resulting silicate will exhibit high absorptivity for moisture and $CO_2$ owing to its enhanced specific surface area to result in remarkably deteriorated quality. The term "mean particle diameter" used in this description refers to a median diameter of particle size distribution.

The crystalline silicate having such a mean particle diameter can be produced by pulverizing crystalline silicate particles of somewhat large sizes by the use of a vibration mill, a hammer mill, a bowl mill, a roller mill or other pulverizer.

Next, the crystalline silicate represented by the formula (III) will be described.

Among the crystalline silicates represented by the formula (III), those wherein x' is 1.7 to 2.2 and y' is 0 are preferable, and those having a cation exchange capacity of 100 to 400 $CaCO_3$mg/g are usable in the present invention. In the present invention, the crystalline silicate represented by the formula (III) serves as one of the substances capable of capturing ions.

As described above, the crystalline silicate represented by the formula (III) exhibits bath a high alkalinizing power and a high buffer capacity in the alkaline (basic) range, and further has a high ion exchange capacity.

The crystalline silicate represented by the formula (III) can generally be prepared by firing amorphous glassy sodium silicate at 200 to 1000° C. to crystallize it, though the production processes therefor are disclosed in JP-A 60-227895 and U.S. Pat. No. 4,664,839 corresponding thereto. Details of the production thereof are described also in, for example, Phys. Chem. Glasses. 7, p.p.127–138 (1966), Z. Kristallogr., 12, p.p.396–404 (1969) and so on. Further, the crystalline silicate represented by the formula (III) is commercially available, e.g., under the trade name of "Na-SKS-6" (composition: δ-$Na_2Si_2O_5$) from Hoechst Ltd. as powder or granule.

It is preferable that the crystalline silicate represented by the formula (III) as well as the one represented by the formula (II) have a mean particle diameter of 0.1 to 100 μm, still preferably 1 to 60 μm.

In the present invention, the crystalline silicates represented by the formula (II) and those represented by the formula (III) may be used each alone or as a mixture of two or more of them. Further, it is preferable that the silicate(s) account for 5 to 100% by weight, still preferably 30 to 100% by weight of the alkaline substances contained in the composition.

From the standpoints of the detergency of the composition and the physical properties thereof as powder, the crystalline silicate may be contained in the composition in an amount of 0 to 40% by weight, preferably 5 to 35% by weight.

<Other builders>

A builder has both the effect of separating solid-particle dirt from clothes and dispersing it in a washing solution and the effect of preventing the solid-particle dirt thus dispersed from redepositing on clothes (resoiling clothes). In order to attain such effects of a builder sufficiently, it is preferable that the high-density powdered detergent composition contain a polycarboxylate having an average molecular weight of hundreds to a hundred thousand, for example, a random copolymer comprising at least one monomer selected from the group consisting of maleic acid, maleic anhydride and salts of maleic acid with sodium, potassium and ammonium and at least one monomer copolymerizable therewith (such as C–$C_8$ olefin, acrylic acid, methacrylic acid, itaconic acid or methallylsulfonic acid), or a homopolymer represented by the following formula (V):

$$-(P)_l- \qquad (V)$$

wherein P is a constituent unit of a homopolymer resulting from a homopolymerizable monomer; and l is a value giving a homopolymer having an average molecular weight of hundreds to a hundred thousand. In this homopolymer, at least part of the constituent units (P's) are converted into at least one salt selected from the group consisting of sodium salt, potassium salt and ammonium salt.

In the above formula (V), the constituent unit of the homopolymer is one resulting from acrylic acid, methacrylic acid, maleic acid or the like.

In the present invention, it is preferable that one or more members selected from among the above random copolymers and the homopolymers of the formula (V) be used in a total amount (or in an amount, when only one of them is used) of 1 to 8% by weight, still preferably 2 to 6% by weight based on the total amount of the detergent composition containing the same. Among these polycarboxylates, salts of acrylic acid/maleic acid copolymers or polyacrylic acid with Na, K and/or $NH_4$ are particularly excellent. The average molecular weight thereof is preferably 1000 to 100000, still preferably 1000 to 80000.

In addition to the above builders, the high-density powdered detergent composition of the present invention can contain also the following inorganic or organic builders.

(I) Inorganic builders 1) alkaline salts such as sodium carbonate, potassium carbonate, sodium bicarbonate, sodium sulfite and sodium sesquicarbonate, 2) salts of phosphoric acids such as orthophosphoric acid, pyrophosphoric acid and tripolyphosphoric acid with alkali metals such as sodium and potassium, 3) neutral salts such as sodium sulfate (II) Organic builders 1) alkali metal salts of phosphonic acids such as ethane-1,1-diphosphonic acid and ethane-1,1,2-triphosphonic acid, 2) polyelectrolytes such as polyethylene glycol, polyvinyl alcohol, polyvinylpyrrolidone, carboxymethylcellulose and polyaspartic acid, 3) alkali metal salts of organic acids such as diglycolic acid and oxydisuccinic acid.

<Other components>

The high-density powdered detergent composition of the present invention may further contain other conventional components for detergents at need, and such components include bleaching agents, bleaching activators, enzymes, enzyme stabilizers, bluing agents, anticaking agents, antioxidants, fluorescent dyes and perfumes.

Examples of the bleaching agents include sodium percarbonate, sodium perborate (with its monohydrate being preferable) and sodium sulfate-hydrogen peroxide adduct, among which sodium percarbonate is particularly preferable.

Examples of the bleaching activators include tetraacetylethylenediamine, acetoxybenzenesulfonic acid salts, organic peroxy acid precursors described in JP-A 59-22999 and U.S. Pat. No. 4,412,934 corresponding thereto, JP-A 63-258447 and U.S. Pat. No. 4,751,015 corresponding thereto, and JP-A 6-316700, and metal catalysts wherein transition metals are stabilized with sequestering agents.

The enzyme to be optionally used in the present invention (which essentially exhibits enzymatic activity in the washing step) is preferably protease, esterase, lipase, carbohydrase, nuclease or pectinase.

Specific examples of the protease include pepsin, trypsin, chymotrypsin, collagenase, keratinase, elastase, subtilisin, BPN, papain, bromelin, carboxypeptidases A and B, aminopeptidase and aspergillopeptidases A and B, which are commercially available under the trade names of "Sabinase" and "Alkarase" (from Novo Industri), "API21" (from Showa Denko, K.K.) and Maxacal (from Gist-Brocades); and proteases K-14 and K-16 described in JP-A 5-25492 and U.S. Pat. No. 5,312,561 corresponding thereto.

Specific examples of the esterase include gastric lipase, pancreatic lipase, plant lipase, phospholipase, choline esterase and phosphatase.

The lipase may be a commercially available one such as "Lipolase" (a product of Novo Industri).

Specific examples of the carbohydrase include cellulase, maltase, saccharase, amylase, lysozyme, α-glycosidase and β-glycosidase.

The cellulase may be "Celluzyme" (a product of Novo Industri) or a cellulase described in claim 4 of JP-A 63-264699 and U.S. Pat. Nos. 4,822,516 and 4,978,470 corresponding thereto, while the amylase may be "Termamyl" (a product of Novo Industri) or the like.

The enzyme stabilizers include reducing agents (such as sodium sulfite and sodium hydrogensulfite), calcium salts, magnesium salts, polyols, boron compounds and so on.

Various bluing agents may also be added to the detergent composition at need. In particular, bluing agents whose chemical structures are disclosed in JP-B 49-8005, 49-26286 and 53-45808 are preferably used.

Examples of the anticaking agents include p-toluenesulfonic acid salts, xylenesulfonic acid salts, acetic acid salts, sulfosuccinic acid salts, talc, finely powdered silica, clay and magnesium oxide. Among finely divided silica and so on, porous ones are usable also as carriers for nonionic surfactants. Further, clay (specifically, smectite clay) is effective also as softener.

Examples of the antioxidants include t-butylhydroxytoluene, 4,4'-butylidenebis(6-t-butyl-3-methylphenol), 2,2'-butylidenebis(6-t-butyl-4-methylphenol), monostyrenated cresol, distyrenated cresol, monostyrenated phenol, distyrenated phenol and 1,1'-bis(4-hydroxyphenyl)cyclohexane.

Further, the detergent composition may contain a fluorescent dye in an amount exceeding 0% by weight but up to 1% by weight, the fluorescent dye being at least one member selected from the group consisting of 4,4'-bis(2-sulfostyryl)biphenyl salts, 4,4'-bis(4-chloro-3-sulfostyryl)biphenyl salts, 2-(styrylphenyl)naphthothiazole derivatives, 4,4'-bis-(triazol-2-yl)stilbene derivatives and bis(triazinylamino) stilbenedisulfonic acid derivatives.

Examples of the perfumes include conventional ones for detergents as described in JP-A 63-101496.

The high-density powdered detergent composition of the present invention takes a powdery or granular form. The process for producing the composition is not particularly limited, but may be any known one. The bulk density of the composition can be enhanced by a process of spraying a nonionic surfactant on spray-dried particles, a process of making a powdery component containing an oil-absorbing carrier occlude a nonionic surfactant, or by referring to the processes described in JP-A 61-69897, 61-69899 and 61-69900, JP-A 2-222498 and U.S. Pat. No. 5,052,122 corresponding to it, JP-A 2-222499, JP-A 3-33199 and EP-A 339996 corresponding to it, JP-A 5-86400 and U.S. Pat. No. 5,282,996 corresponding to it, and JP-A 5-209200 and U.S. Pat. No. 5,468,516 corresponding to it.

When a crystalline aluminosilicate is used as the component (d), a small portion of the crystalline aluminosilicate may be added during the granulation or just before the completion of the granulation as the surface modifier for the granules. When a crystalline silicate is used, it is preferable that the silicate be added in the step of enhancing the bulk density or dry-blended with the granules. When an alkali metal carbonate is used, it may be added to the slurry or at any step during the granulation, or dry-blended with the granules.

It is desirable from the standpoint of the physical properties of the composition as powder that the high-density powdered detergent composition of the present invention has a mean particle diameter of 200 to 1000 $\mu$m, particularly 200 to 600 $\mu$m. Further, the detergent composition of the present invention has a bulk density of 0.6 to 1.2 g/ml, preferably 0.6 to 1.0 g/ml.

The detergent composition of the present invention may be used in a suitable concentration, which depends on which of several washing methods (such as machine washing and immersion) is employed, quantity of clothes or water, extent of stains, operating conditions of the machine, or the like. In machine washing, for example, the composition may be used in a concentration of 0.03 to 0.3% by weight.

As described above, the present invention can provide a high-density powdered detergent composition which contains both an organic builder excellent in biodegradability and an inorganic builder and is enhanced in detergency.

EXAMPLE

The present invention will now be described in detail by referring to the following Example, though the present invention is not limited by it.

Example 1

Preparation of high-density powdered detergent compositions

Composition 1 specified in Table 1 was prepared according to the following procedure.

An aqueous slurry having a solid content of 60% by weight was prepared by using 0.5 kg of MGDA, 0.55 kg of crystalline aluminosilicate, 4.0 kg of LAS, 0.3 kg of AA-MA copolymer, 0.4 kg of FA, 0.25 kg of sodium silicate and 0.9 kg of soda ash (sodium carbonate). The obtained slurry was subjected to spray drying. The particles thus obtained were put in a Lödige mixer (mfd. by Matsuzaka Giken K.K.), followed by the addition thereto of 2.0 kg of silicate (II), 0.25 kg of crystalline aluminosilicate, 0.1 kg of an enzyme, the balance of Glauber's salt and 0.05 kg of a fluorescent dye [i.e., 4,4'-bis(2-sulfostyryl)biphenyl salt]. The resulting mixture was agitated, while 0.2 kg of AE-1 and 0.1 kg of PEG which had been preheated to 70° C. were gradually dropped into the mixture. Thus, the mixture was granulated. Then, 0.25 kg of crystalline aluminosilicate was added to the granulated mixture, and the obtained mixture was further subjected to granulation. Thus, a high-density powdered detergent composition having a mean particle diameter of 430 $\mu$m and a bulk density of 0.810 g/ml was obtained.

The other high-density powdered detergent compositions were also prepared according to the same procedure as that described above except that components listed in Tables 1 to 3 were used in proportions specified in Tables 1 to 3. The obtained powdered detergent compositions had bulk densities of 0.800±0.050 g/ml.

The high-density powdered detergent compositions were subjected to the following detergency test. The results are given in Tables 1 to 3.

<Detergency test>

Preparation of artificially stained cloths

Artificially stained cloths were prepared by making an artificial dirt solution adhere to cloths, with the formulation of the artificial dirt solution being described below. This adhesion was conducted by printing cloths with the artificial dirt solution by the use of a gravure roll coater. The preparation of the artificially stained cloths was conducted under the conditions of a cell capacity of gravure roll of 58 $cm^3/cm^2$, a coating speed of 1.0 m/min, a drying temperature of 100° C., and a drying time of one minute. Cotton shirting cloth #2003 (a product of Yato Shoten) was used in the above preparation of the artificially stained cloths.

Formulation of artificial dirt solution

| | |
|---|---|
| lauric acid | 0.44 |
| (% by weight, the same applies hereunder) | |
| myristic acid | 3.09 |
| pentadecanoic acid | 2.31 |
| palmitic acid | 6.18 |
| heptadecanoic acid | 0.44 |
| stearic acid | 1.57 |
| oleic acid | 7.75 |
| triolein | 13.06 |
| n-hexadecyl palmitate | 2.18 |
| squalene | 6.53 |
| liquid-crystalline albumen | 1.94 |
| lecithin | |

-continued

| | |
|---|---|
| Kanuma Aka-tsuchi (a kind of tephra) | 8.11 |
| carbon black | 0.01 |
| tap water | the balance |

Washing conditions and evaluation method

Five artificially stained cloths (10 cm×10 cm) prepared above and 1 l of an aqueous solution of a sample detergent composition were put in a Terg-O-Tometer to conduct the washing at 100 rpm. The washing conditions are as follows:

Washing conditions

| | |
|---|---|
| washing time | 10 min, |
| detergent concn. | 0.067 w/v %, |
| hardness of water | 4 ° DH, |
| temp. of water | 20° C., and |
| rinsing | with tap water (running water) for 5 min. |

The detergency of each detergent composition was determined by measuring the reflectivities at 550 nm of the unstained cloth and the stained cloth before and after the washing by the use of a self-colorimeter (mfd. by Shimadzu Corporation) and calculating the rate (%) of cleansing according to the following formula. The rates of cleansing observed with respect to the five cloths were averaged, and the average is given in Tables 1 to 3 as the rate of cleansing of the composition.

Rate of cleansing (%)=(reflectivity after washing−that before washing)/(that of unstained cloth−that before washing)×100

TABLE 1

| | | | Compn. No. | | | | | | |
|---|---|---|---|---|---|---|---|---|---|
| | | | 1 | 2 | 3 | 4 | 5 | 6 | 7 |
| Formulation (wt. %) | component a | MGDA | 5.0 | 10.0 | 15.0 | 20.0 | 10.0 | 10.0 | 10.0 |
| | component b | LAS | 40.0 | 40.0 | 40.0 | 40.0 | 40.0 | 40.0 | 30.0 |
| | | AS | 0 | 0 | 0 | 0 | 0 | 0 | 5.0 |
| | | FA | 4.0 | 4.0 | 4.0 | 4.0 | 4.0 | 4.0 | 9.0 |
| | component c | AE-1 | 2.0 | 2.0 | 2.0 | 2.0 | 2.0 | 0 | 2.0 |
| | | AE-2 | 0 | 0 | 0 | 0 | 0 | 2.0 | 0 |
| | AE-3 | | 0 | 0 | 0 | 0 | 0 | 0 | 0 |
| | component d | cryst. alumino-silicate (zeolite) | 10.5 | 10.5 | 10.5 | 5.5 | 10.5 | 10.5 | 10.5 |
| | silicate (II) | | 20 | 20 | 20 | 20 | 0 | 20 | 20 |
| | silicate (III) | | 0 | 0 | 0 | 0 | 20 | 0 | 0 |
| | JIS No. 2 sodium silicate | | 2.5 | 2.5 | 1.5 | 1.5 | 2.5 | 2.5 | 4.0 |
| | other components | AA-MA copolymer | 3.0 | 3.0 | 3.0 | 3.0 | 3.0 | 3.0 | 3.0 |
| | | PEG | 1.0 | 1.0 | 1.0 | 1.0 | 1.0 | 1.0 | 1.0 |
| | | sodium carbonate | 9.0 | 4.0 | 0 | 0 | 4.5 | 4.5 | 2.5 |
| | | common component | balance | balance | balance | balance | balance | balance | balance |
| | sum total (%) | | 100.0 | 100.0 | 100.0 | 100.0 | 100.0 | 100.0 | 100.0 |
| Result | rate of cleansing (%) | | 73.1 | 75.0 | 76.1 | 74.6 | 74.8 | 71.4 | 74.5 |

TABLE 2

| | | | Compn. No. | | | | | | |
|---|---|---|---|---|---|---|---|---|---|
| | | | 8 | 9 | 10 | 11 | 12 | 13 | 14 |
| Formulation (wt. %) | component a | MGDA | 10.0 | 10.0 | 10.0 | 10.0 | 10.0 | 10.0 | 10.0 |
| | component b | LAS | 20.0 | 20.0 | 40.0 | 40.0 | 40.0 | 40.0 | 40.0 |
| | | AS | 5.0 | 0 | 0 | 0 | 0 | 0 | 0 |
| | | FA | 19.0 | 4.0 | 4.0 | 4.0 | 4.0 | 4.0 | 4.0 |
| | component c | AE-1 | 2.0 | 1.2 | 1.0 | 0.8 | 4.0 | 2.0 | 2.0 |
| | | AE-2 | 0 | 0 | 0 | 0 | 0 | 0 | 0 |
| | AE-3 | | 0 | 0 | 0 | 0 | 0 | 0 | 0 |
| | component d | cryst. alumino-silicate (zeolite) | 10.5 | 10.5 | 10.5 | 10.5 | 10.5 | 17.5 | 5.5 |

TABLE 2-continued

| | | | Compn. No. | | | | | | |
|---|---|---|---|---|---|---|---|---|---|
| | | | 8 | 9 | 10 | 11 | 12 | 13 | 14 |
| | silicate (II) | | 20 | 20 | 20 | 20 | 20 | 20 | 20 |
| | silicate (III) | | 0 | 0 | 0 | 0 | 0 | 0 | 0 |
| | JIS No. 2 sodium silicate | | 0 | 18.3 | 3.0 | 4.2 | 0 | 0 | 2.5 |
| | other components | AA-MA copolymer | 3.0 | 3.0 | 3.0 | 3.0 | 3.0 | 3.0 | 3.0 |
| | | PEG | 1.0 | 1.0 | 1.0 | 1.0 | 1.0 | 1.0 | 1.0 |
| | | sodium carbonate | 6.5 | 9.0 | 4.5 | 3.5 | 4.5 | 0 | 9.0 |
| | | common component | balance | balance | balance | balance | balance | balance | balance |
| | sum total (%) | | 100.0 | 100.0 | 100.0 | 100.0 | 100.0 | 100.0 | 100.0 |
| Result | rate of cleansing (%) | | 73.6 | 73.0 | 72.1 | 70.0 | 74.8 | 75.5 | 74.1 |

TABLE 3

| | | | Compn. No. | | | | | | |
|---|---|---|---|---|---|---|---|---|---|
| | | | 15 | 16 | 17 | 18 | 19 | 20 | 21 |
| Formulation (wt. %) | component a | MGDA | 10.0 | 10.0 | 10.0 | 10.0 | 10.0 | 10.0 | 10.0 |
| | component b | LAS | 40.0 | 40.0 | 40.0 | 40.0 | 40.0 | 40.0 | 40.0 |
| | | AS | 0 | 0 | 0 | 0 | 0 | 0 | 0 |
| | | FA | 4.0 | 4.0 | 4.0 | 4.0 | 4.0 | 4.0 | 4.0 |
| | component c | AE-1 | 2.0 | 2.0 | 2.0 | 0 | 6.0 | 2.0 | 0 |
| | | AE-2 | 0 | 0 | 0 | 0 | 0 | 0 | 0 |
| | AE-3 | | 0 | 0 | 0 | 2.0 | 0 | 0 | 0 |
| | component d | cryst. alumino-silicate (zeolite) | 10.5 | 10.5 | 10.5 | 10.5 | 10.5 | 0 | 10.5 |
| | silicate (II) | | 2.5 | 5.0 | 10.0 | 20 | 20 | 20 | 20 |
| | silicate (III) | | 0 | 0 | 0 | 0 | 0 | 0 | 0 |
| | JIS No. 2 sodium silicate | | 20.5 | 18.0 | 12.5 | 2.5 | 0 | 13.0 | 12.5 |
| | other components | AA-MA copolymer | 3.0 | 3.0 | 3.0 | 3.0 | 3.0 | 3.0 | 3.0 |
| | | PEG | 1.0 | 1.0 | 1.0 | 1.0 | 1.0 | 1.0 | 1.0 |
| | | sodium carbonate | 4.0 | 4.0 | 4.0 | 4.0 | 2.5 | 4.0 | 6.0 |
| | | common component | balance | balance | balance | balance | balance | balance | balance |
| | sum total (%) | | 100.0 | 100.0 | 100.0 | 100.0 | 100.0 | 100.0 | 100.0 |
| Result | rate of cleansing (%) | | 67.0 | 70.4 | 72.8 | 60.1 | 64.4 | 63.1 | 63.6 |

notes)

MGDA: trisodium salt of methylglycine-N,N'-diacetic acid

LAS: sodium salt of linear alkyl($C_{12}$)benzenesulfonic acid

AS: sodium salt of dodecyl alcohol sulfate

FA: sodium salt of tallow fatty acid

AE-1: polyoxyethylene dodecyl ether (HLB value: 13.1)

AE-2: polyoxyethylene dodecyl ether (HLB value: 12.0)

AE-3: polyoxyethylene dodecyl ether (HLB value: 16.0)

cryst. alluminosilicate: (composition: $Na_2O.Al_2O_3.2SiO_2.2H_2O$, mean particle diam.: 2 $\mu$m, ion exchange capacity: 290 $CaCO_3$ mg/g)

silicate (II): crystalline silicate represented by the formula (II) (see "Detailed Description of the Invention") [Composition: $M_20.1.8SiO_2.0.02M'O$ (wherein M is Na and K, K/Na being 0.03; and M' is Ca and Mg, Mg/Ca being 0.01), mean particle diam: 30 $\mu$m, ion exchange capacity: 305 $CaCO_3$ mg/g]

silicate (III): crystalline silicate represented by the formula (III) (see "Detailed Description of the invention") (Composition: $Na_2O.2SiO_2$, mean particle diam: 30 $\mu$m, ion exchange capacity: 224 $CaCO_3$ mg/g)

AA-MA copolymer: acrylic acid/maleic acid (7/3, by mole) copolymer having an average molecular weight of 70000

PEG: polyethylene glycol having an average molecular weight of 7000 common component: comprising 1 wt. % of an enzyme mixture [comprising API-21H (a product of Showa Denko K.K), Lipolase 100 T (a product of Novo Nordisk), Celluzyme 0.1T (a product of Novo Nordisk), and Termamyl 60T (a product of Novo Nordisk) at a weight ratio of 2:1:1:1], 0.5 wt. % of a fluorescent dye and the balance (such an amount as to make a total of 100 wt. %) of Glauber's salt, each content being based on the total weight of the detergent composition.

What is claimed is:

1. A high-density powdered detergent composition which has a bulk density of 0.6 to 1.2 g/ml and which comprises 0.5 to 30% by weight of (a) a glycine-N,N-diacetic acid derivative represented by the following formula (I), 20 to 50% by weight of (b) an anionic surfactant, 0.5 to 5% by weight of (c) an ether-containing nonionic surfactant having an HLB (Hydrophile Lypophile Balance) value of 10.5 to 15.0 and 1 to 30% by weight of (d) an aluminosilicate, each percentage being based on the total weight of the composition, and the component (c) being contained in an amount of 0.5 to 10.0 parts by weight per 100 parts by weight of the component (b):

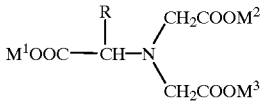

(I)

wherein R is $C_1$–$C_{18}$ alkyl or $C_2$–$C_{18}$ alkenyl; and $M^1$, $M^2$ and $M^3$ are each H, Na, K or $NH_4$.

2. The high-density powdered detergent composition according to claim 1, wherein the anionic surfactant contained as the component (b) is at least one compound selected from the group consisting of $C_{10}$–$C_{18}$ higher fatty acid salts, salts of sulfates of $C_{10}$–$C_{18}$ linear and branched primary and secondary alcohols, salts of sulfates of $C_8$–$C_{20}$ alcohol ethoxylates, alkylbenzenesulfonic acid salts, paraffinsulfonic acid salts, α-olefinsulfonic acid salts, α-sulfofatty acid salts and salts of alkyl esters of α-sulfofatty acids.

3. The high-density powdered detergent composition according to claim 1, wherein the content of the component (b) is 20 to 40% by weight.

4. The high-density powdered detergent composition according to claim 1, wherein the component (c) has an HLB value of 11.0 to 14.0.

5. The high-density powdered-detergent composition according to claim 1, which further contains a polycarboxylate having an average molecular weight of 1000 to 100000.

6. The high-density powdered detergent composition according to claim 1, wherein the ether-containing nonionic surfactant (c) is prepared by an addition reaction of a linear or branched primary or secondary alcohol having 10 to 18 carbon atoms with 4 to 13 ethylene oxide molecules.

7. The high-density powdered detergent composition according to claim 1, wherein the aluminosilicate (d) is amorphous.

8. The high-density powdered detergent composition according to claim 1, wherein the aluminosilicate (d) is crystalline.

9. The high-density powdered detergent composition according to claim 7, wherein the amorphous aluminosilicate (d) contains silicon in an amount of 30% by weight or above in terms of $SiO_2$.

10. The high-density powdered detergent composition according to claim 9, wherein the amorphous aluminosilicate (d) is represented by the following formula (i):

$$a(M_2O).Al_2O_3.b(SiO_2).c(H_2O) \quad \text{(i)}$$

wherein M is alkali metal; and a, b and c represent the molar proportions of the constituent components respectively, a is a number of 0.7 to 2.0, b is a number of 0.8 to less than 4, and c is an arbitrary positive number.

11. The high-density powdered detergent composition according to claim 10, wherein the amorphous aluminosilicate (d) is represented by the following formula (ii):

$$Na_2O.Al_2O_3.b(SiO_2).c(H_2O) \quad \text{(ii)}$$

wherein b is a number of 1.8 to 3.2; and c is a number of 1 to 6.

12. The high-density powdered detergent composition according to claim 8, wherein the crystalline aluminosilicate (d) is represented by the following formula (iii):

$$a'(M_2O).Al_2O_3.b'(SiO_2).w(H_2O) \quad \text{(iii)}$$

wherein M is alkali metal; a' is a number of 0.7 to 1.5, b' is a number of 0.8 to less than 6, and w is an arbitrary positive number.

13. The high-density powdered detergent composition according to claim 12, wherein the crystalline aluminosilicate (d) is represented by the following formula (iv):

$$Na_2O.Al_2O_3.n(SiO_2).w(H_2O) \quad \text{(iv)}$$

wherein n is a number of 1.8 to 3.0, w is a number of 1 to 6.

14. The high-density powdered detergent composition according to claim 8, wherein the crystalline aluminosilicate (d) is a synthetic zeolite of form A, X, P or mixtures thereof.

15. The high-density powdered detergent composition according to claim 1, further comprising a crystalline silicate.

16. The high-density powdered detergent composition according to claim 15, wherein the crystalline silicate is represented by the following formula (II):

$$x(M_2O).y(SiO_2).z(Me_mO_n).w(H_2O) \quad \text{(II)}$$

wherein M is a Group Ia element of the periodic table; Me is at least one element selected from among Group IIa, IIb, IIIa, IVa and VIII elements of the periodic table; y/x is a number of 0.5 to 2.6; z/x is a number of 0.01 to 1.0; w is a number of 0 to 20; and n/m is a number of 0.5 to 2.0.

17. The high-density powdered detergent composition according to claim 15, wherein the crystalline silicate is represented by the following formula (III):

$$M_2O.x'(SiO_2).y'(H_2O) \quad \text{(III)}$$

wherein M is alkali metal; x' is a number of 1.5 to 2.6; and y' is 0 to 20.

18. The high-density powdered detergent composition according to claim 15, wherein the crystalline silicate has an ion exchange capacity of at least 100 $CaCO_3$ mg/g.

19. The high-density powdered detergent composition according to claim 5, wherein the polycarboxylate is a random copolymer comprising:

at least one Fonomer selected from the group consisting of maleic acid, maleic anhydride, and salts of maleic acid with sodium, potassium and ammonium, and at least one monomer copolymerizable therewith comprising $C_1$–$C_8$ olefin, acrylic acid, methacrylic acid, itaconic acid or methallylsulfonic acid.

20. The high-density powdered detergent composition according to claim 5, wherein the polycarboxylate is a homopolymer prepared from acrylic acid, methacrylic acid or maleic acid.

* * * * *